United States Patent [19]

Pavlov et al.

[11] Patent Number: 4,869,969

[45] Date of Patent: Sep. 26, 1989

[54] METALLIC WALL HAVING COINED KNOCKOUTS AND METHOD OF FORMING

[75] Inventors: Zorica Pavlov, Hinsdale; Vijay B. Patel, Orland Park, both of Ill.

[73] Assignee: Allied Tube & Conduit Corporation, Harvey, Ill.

[21] Appl. No.: 189,615

[22] Filed: May 3, 1988

[51] Int. Cl.[4] ..... G09F 15/00; E01F 9/01

[52] U.S. Cl. ..... 428/572; 428/571; 428/577; 40/606

[58] Field of Search ..... 428/571, 572, 600, 601, 428/596, 577; 52/735; 256/DIG. 5; 40/606; 83/51

[56] References Cited

U.S. PATENT DOCUMENTS

| | | | |
|---|---|---|---|
| 2,109,921 | 3/1938 | Leach | 428/600 |
| 2,350,004 | 5/1944 | Whistler et al. | 428/571 |
| 2,401,208 | 5/1946 | Walensky | 83/879 |
| 2,781,097 | 2/1957 | Nold | 72/326 |
| 3,359,773 | 12/1967 | Stuchbery | 72/325 |
| 3,583,266 | 6/1971 | Kondo et al. | 83/51 |
| 4,348,464 | 9/1982 | Khoury | 428/571 |
| 4,362,078 | 12/1982 | Ohnishi et al. | 83/51 |
| 4,477,537 | 10/1984 | Blase et al. | 428/687 |
| 4,487,539 | 12/1984 | Taylor et al. | 83/51 |
| 4,561,579 | 12/1985 | Fleming et al. | 83/51 |
| 4,611,480 | 9/1986 | Willets | 72/326 |

*Primary Examiner*—John J. Zimmerman

*Attorney, Agent, or Firm*—Fitch, Even, Tabin & Flannery

[57] ABSTRACT

A metallic wall having coined knockouts. The wall includes a first surface and a second surface spaced from the first surface. A plurality of spaced knockout portions are positioned in incipient apertures in the wall and are disposed substantially between the surfaces. Each knockout portion is defined by a first indentation encompassing the knockout portion and extending from the first surface, and by a second indentation encompassing the knockout portion and extending form the second surface. These indentations are in alignment with a web of material of substantially uniform thickness throughout its length spacing the indentations. The outside surface defining the first indentation is inclined inwardly. A coating is applied to the second surface after formation of the indentations. A sharp blow to the knockout portion from the second surface fractures the web to allow removal of the knockout portion without any material of the wall extending substantially beyond the first surface. A method of fabricating galvanized steel tubing having the knockout portions is also disclosed.

7 Claims, 2 Drawing Sheets

METALLIC WALL HAVING COINED KNOCKOUTS AND METHOD OF FORMING

The present invention relates to metallic structural members and, more particularly, to such a member having a plurality of spaced apertures filled by knockout portions permitting mounting of the item(s) to be supported at a variety of locations along the member.

BACKGROUND OF THE INVENTION

It is common in the manufacture of sign posts and the like to provide one or more series of regularly spaced mounting apertures along the length of the post. This permits convenient field installation of the sign on the post after the post has been set. It thus avoids the need for drilling apertures in the field and even removes the need for the installer to decide at what point along the post the sign is to be mounted, until after the post is set.

When such posts are manufactured by a continuous rolling mill, the apertures must be provided as an additional manufacturing step performed either before or after the tube formation process. In the typical continuous rolling process for forming tubing without apertures, flat stock is transversely bent until the lateral ends are brought into abutment and welded together to form a tube. The formed tube is then subjected to alkali wash, water rinse and pickling steps to remove dirt, grease and other contaminants prior to drying in preparation for galvanization of the outside surface of the tube by passing the tube through a molten zinc bath. The flat stock cannot be provided with the apertures prior to tube formation and still retain the galvanization step after tube formation because the wash, rinse and pickling liquids would have access to the inside of the formed tube where they could not be effectively removed prior to galvanizing. The entrance of such cleansing liquids into the molten zinc bath could have catastrophic consequences. Not only would the zinc bath be contaminated, but water and molten zinc are an explosive combination. Thus the flat stock is either galvanized prior to punching the apertures and the tube formation process occurring without the typical galvanization step; or the tube is formed in the above-described typical manner with the apertures formed in the tube off-line as a last manufacturing step.

It is common that no additional corrosion protection is applied after the series of mounting holes is drilled in a length of pipe. Thus, the material defining these apertures is bare metal and has no protective coating. The aperture used to mount the sign is somewhat shielded from the elements by the presence of the sign and the mounting fastener. However, the remaining apertures, available but unused, represent easy targets for the onset of rust. Rust not only makes the post unsightly, but is progressively weakens the post until the point where the post is structurally insufficient and must be replaced. Rusting continues under normal environmental conditions and under extreme conditions, such as the splashing of salt water on the posts by passing vehicles, the rusting process is greatly accelerated.

Apart from the oxidation problem, the provision of a series or multiple series of apertures in the post also results in a significant reduction of the load-carrying ability of the post. This is particularly true when the post is used as a horizontally disposed, load-carrying member. With the use of so many holes, thicker gauge stock is required to obtain a given load rating.

A sign post has been proposed including a number of mounting apertures so completely filled by knockouts as to render the wall forming the post impervious to liquids. Each knockout is connected to the surrounding material defining the aperture by a number of tabs. While this post works well for its intended purpose, removal of a knockout by application of a sharp blow can cause the material forming the tabs to extend inside the post where it can interfere with telescopic reception of a close-fitting extension post by the sign post. For further information regarding the structure and operation of such a sign post, reference may be made to commonly assigned U.S. Pat. No. 4,611,480, the teachings of which are hereby incorporated by reference.

SUMMARY OF THE INVENTION

Among the several aspects of the present invention may be noted the provision of an improved metallic structural member for holding an object and a method of manufacturing that member. The structural member provides for simplified mounting of the object without the need for drilling mounting holes in the field, and allows the installer to set the structural member prior to identifying the precise mounting location. Another objective of the present invention is to provide the structural member with increased corrosion resistance and better appearance, increased load-carrying capability and the capability of telescopically receiving another post in a close fit. The method of the present invention permits a tube having knockout portions to be formed and galvanized on a continuous tube mill. The post of the present invention is reliable in use, has long service life and is relatively easy and economical to manufacture. Other aspects and features of the present invention will be in part apparent and in part pointed out hereafter in the following specification and accompanying drawings.

Briefly, various aspects of the present invention are embodied in an elongated wall formed of steel. The wall has a first surface and a second surface spaced from the first surface. A plurality of spaced knockout portions are positioned in incipient apertures in the wall with the portions positioned substantially between the surfaces. Each knockout portion is defined by a first indentation encompassing the knockout portion and extending from the first surface and by a second indentation encompassing the knockout portion and extending from the second surface. The indentations are in alignment with a web of material of substantially uniform thickness throughout its length spacing the indentations. Additionally, the wall includes a coating applied to the second surface after formation of the indentation. Application of a sharp blow to a knockout portion from the second surface causes fracture of the web to allow removal of the knockout portion without any material in the wall extending substantially beyond the first surface.

BRIEF DESCRIPTION OF THE DRAWINGS

Corresponding reference characters indicate corresponding components throughout FIGS. 2–9.

DESCRIPTION OF THE PREFERRED EMBODIMENT

Figure 2:
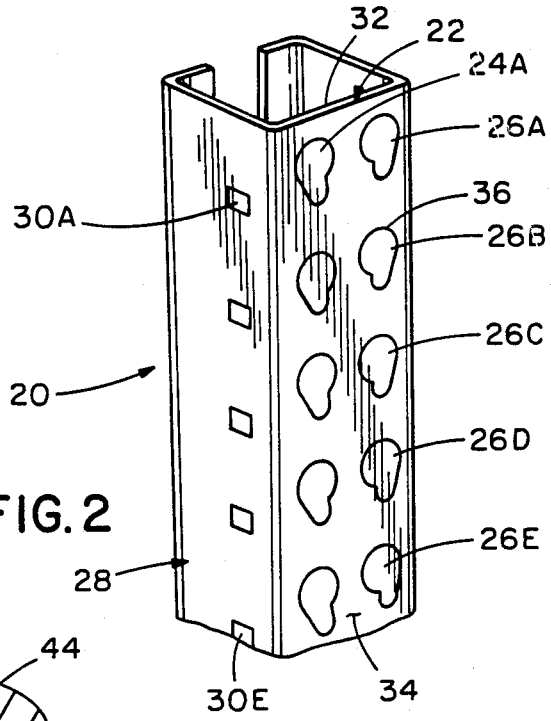
FIG. 2 is a perspective view of a length of channel formed in accordance with the present invention which corresponds to the prior art channel of FIG. 1 in that it has knockout portions which can be selectively removed to provide apertures substantially identical to those of the prior art channel.

Referring now to the drawings, a structural member of the present invention is generally indicated in FIG. 2 by reference character 20. Member 20 is channel-shaped metallic post having a front wall 22 provided with a number of knockout portions 24A-E and 26A-E, and a side wall 28 having a plurality of spaced knockout portions 30A-E. The front wall 22 has an interior or first surface 32 and an exterior or second surface 34. Each knockout portion 24 and 26 in the front wall is defined by a first indentation encompassing that knockout portion and extending from the interior surface 32, and by a second indentation encompassing the knockout portion and extending from the exterior surface 34, for example, second indentation 36 defines knockout portion 26B. As will be explained more fully hereinafter, the first and second indentations associated with each knockout portion are in alignment with a web of material of substantially uniform thickness throughout its length spacing the indentation. Each knockout portion can be considered to occupy an incipient mounting aperture and a predetermined aperture can be opened by applying force to the knockout portion as by hitting with a hammer a punch centered on the knockout portion.

Figure 1:
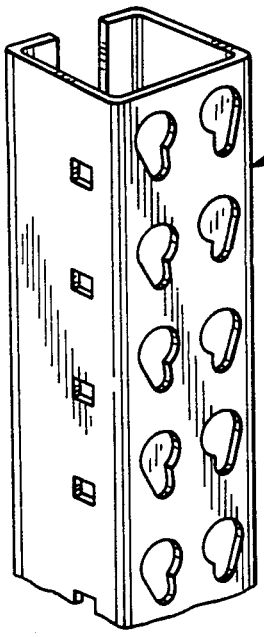
PRIOR ART FIG. 1
FIG. 1 is a perspective view of a length of prior art channel having a number of mounting apertures of various shapes.

It is easily discernible that member 20 is the equivalent of a prior art mounting post 38 shown in FIG. 1. That is, member 20 and post 38 have corresponding mounting locations. These are the apertures in the post 38 and the incipient apertures in member 20 filled by the knockout portions. In fact, structural member 20 could be transformed into post 38 by simply removing all the knockout portions. This would be undesirable because member 20, having its apertures filled, has greater beam and column strength than post 38. Furthermore, as will be explained more fully hereinafter, with post 38 it is typical that a corrosion protective coating would not be applied to the strip from which post 38 is formed, after the apertures are punched. Thus the apertures are defined by bare metal, typical steel. This allows the rusting process to commence almost immediately. With structural member 20, however, the apertures are effectively plugged by the knockout portions. Only after a knockout portion is removed in preparation for mounting is bare metal exposed. And then the bare metal defining the exposed aperture is somewhat shielded from the elements by the presence of the mounted object and the mounting fastener extending through the aperture. An additional advantage of structural member 20 is that the plugged apertures do not have sharp exposed edges which could cut the installer's fingers.

Figure 3:
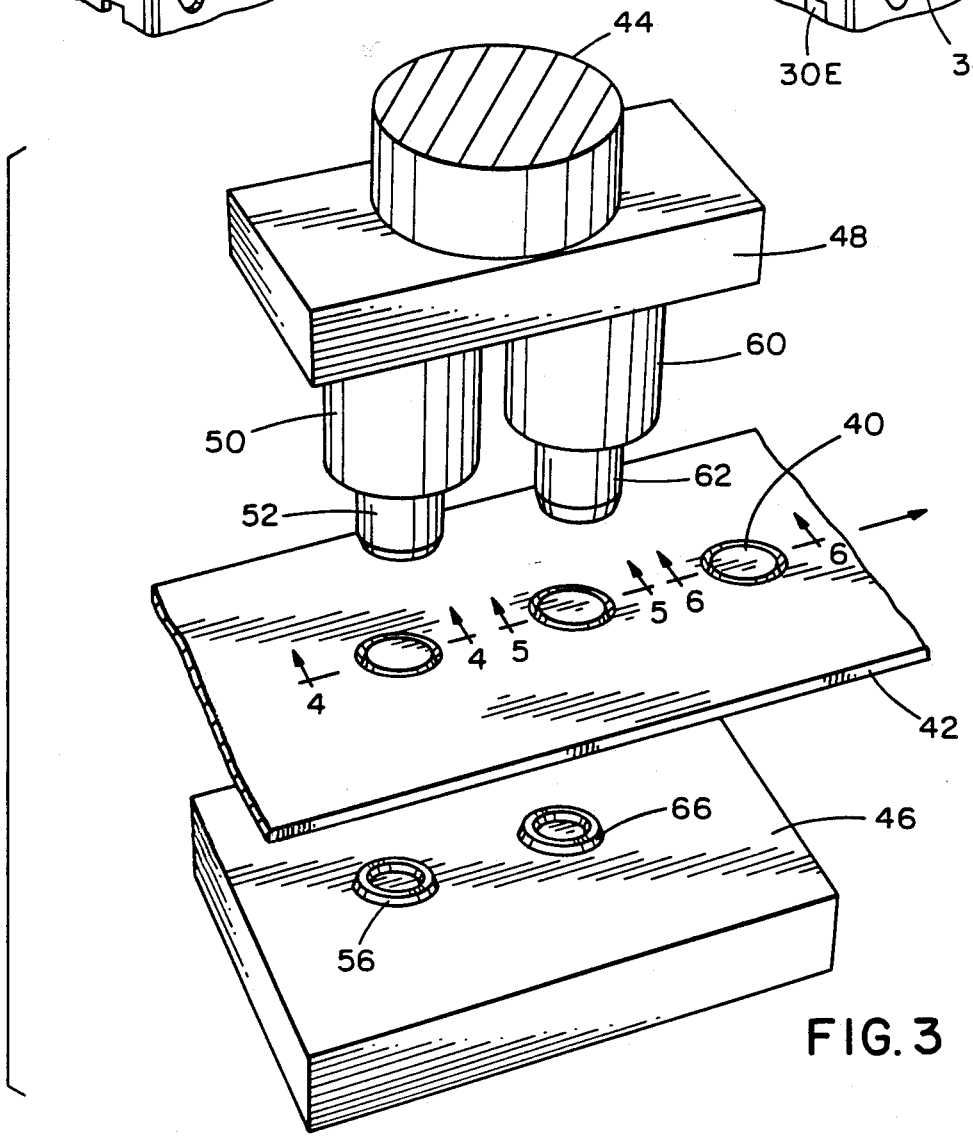
FIG. 3 is a perspective view of certain components of a simplified progressive die arrangement for use in forming circular knockouts, in accordance with the present invention, in a substantially flat length of metallic material, which die arrangement indents or coins the length to define the knockouts.
Figure 4:
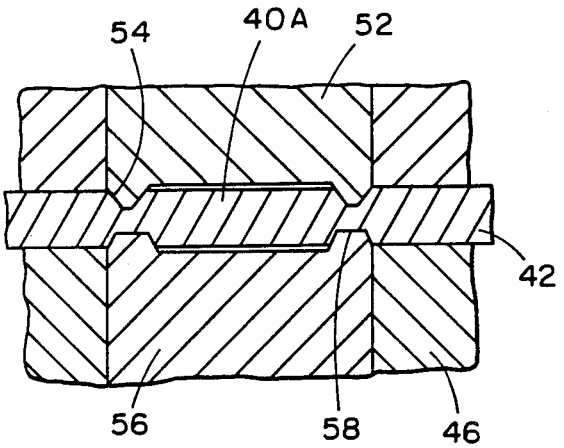
FIG. 4 is a cross-sectional view, taken generally along line 4—4 of FIG. 3 (except with the die arrangement in its extended position), at a first station of the die arrangement showing formation of an incipient knockout.

Referring to FIG. 3, certain components of a simplified progressive die arrangement are shown for providing circular knockout portions 40 in a flat strip 42 of metallic material. This arrangement includes reciprocal press means (not shown) and drive means (also not shown) for advancing strip 42 in stepwise fashion in the direction of the arrow in synchronization with operation of the press means. Such press means and drive means are well known to those of skill in the art and need not be further described. Attached to the press means is a fixture comprising a rod 44 affixed to the ram of the press for undergoing reciprocal movement therewith relative to an anvil 46 held by the press bed in precise alignment with rod 44. The rod 44 supports a block 48 dependent from which is an upstream station chuck means 50 holding a first or upper indentor 52 having an annular working face 54 (best shown in FIG. 4) which is generally V-shaped in section. Positioned on anvil 46 in alignment with indentor 52 is an upstream lower indentor 56 having an annular working face 58 which, as shown in FIG. 4, is generally U-shaped in section.

Figure 5:
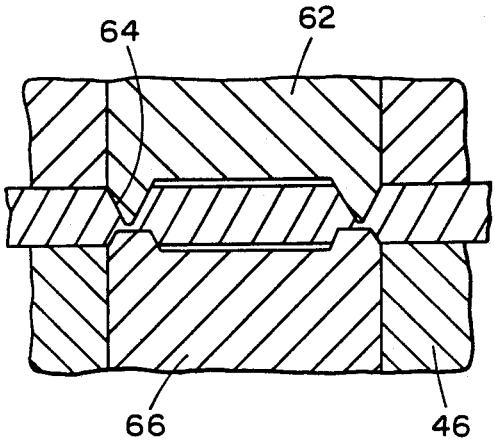
FIG. 5, similar to FIG. 4, and taken generally along line 5—5 of FIG. 3 (except with the die arrangement in its position), shows a fully formed knockout at the second or downstream die station.

The die arrangement also has a downstream station including a downstream chuck means 60 held by the block 48 and carrying an upper indentor 62 which, like indentor 52, is annular and has a working face 64 (see FIG. 5) which is generally V-shaped. Indentor 62 extends closer to the anvil than indentor 52, and the working face 64 is more sharply pointed than working face 54. Disposed in vertical alignment with downstream upper indentor 62 is a lower indentor 66 carried by the anvil 46 and which can be substantially identical to lower indentor 56.

Operation of the progressive die arrangement is as follows: Extension of the ram of the press results, as shown in FIG. 4, in the material of the flat strip 42 at the upstream station between indentors 52 and 56 being impressed to form an incipient knockout portion 40A. It will be appreciated that because the upstream indentor 52 has an extension toward the anvil 46 less than the downstream indentor 62, which forms the final knockout portion 40, the impression formed by the indentor 52 results in the incipient web formed at the upstream station having a greater thickness than the completed web formed at the downstream station of the progressive die arrangement.

As the ram moves to its retracted position, the drive means functions to lift the strip above the level of the lower indentor 56 and advance the strip 47 in the direction of the arrow in FIG. 3 until the incipient knockout portion 40A moves to the downstream station where it is positioned between upper indentor 62 and lower indentor 66. The drive means holds the knockout portion in position as the press ram moves towards its extended position, shown in FIG. 5, in which the completed knockout is formed. The drive means thereafter advances the strip 42 in stepwise fashion in concert with reciprocal operation of the press means until formation of the desired number of knockout portions is completed.

While the components of the simplified progressive die means just discussed only form a single completed knockout portion per ram stroke, it will be apparent to those of skill in the art that the block 48 can carry a plurality of indentors of various shapes at the upstream station and a like plurality of indentors of corresponding shapes at the downstream station. Thus a number of knockout portions can be formed with each extension of the ram.

Figure 6:
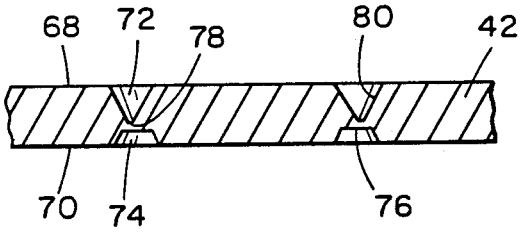
FIG. 6 is a cross-sectional view taken generally along line 6—6 of FIG. 3 illustrating a completed knockout.
Figure 7:
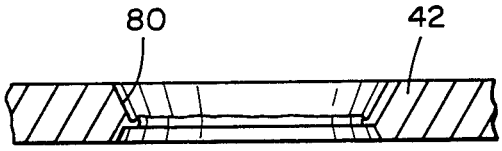
FIG. 7, similar to FIG. 6, shows the flat length of material with the knockout removed.

Referring now to FIG. 6 which shows the completed knockout portion 40, the flat strip 42 can be considered to have a first surface 68 which will become the interior surface of a structural member and a second surface 70. The knockout portion is defined by the first indentation 72 which is of substantially V-shape so that the basal portion thereof is pointed, and further defined by the second indentation 74 which is substantially U-shaped and extends to a generally flat basal surface 76. Disposed between the aligned first and second indentations is the web 78 of material which encompasses the knockout portion 40 and has substantially uniform thickness throughout its length. The web 78 is preferably positioned closer to the second surface 70 than to the first surface 72 so that when a sharp blow is applied to the knockout portion 40 from the second surface 70 causing the web to fracture, any deformed material from the web remaining after removal of the knockout does not extend beyond the first surface 68. FIG. 7 shows the flat strip 42 with the knockout portion 40 removed.

The first indentation is formed by an outside surface 80 which is inclined inwardly. Furthermore, the basal portion of the first indentation 72 is not centered on the second indentation 74 but is disposed somewhat outwardly with respect to the center of indentation 74. It will be appreciated that the presence of the webs 78 makes the strips 42 impervious to liquids.

Figure 8:
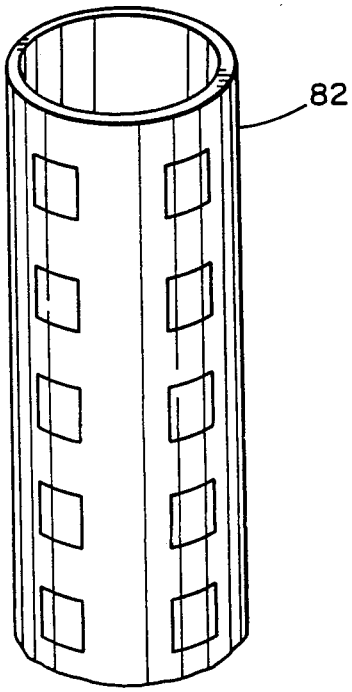
FIG. 8 is a perspective view of a length of tubing of generally circular cross section formed in accordance with the present invention.
Figure 9:
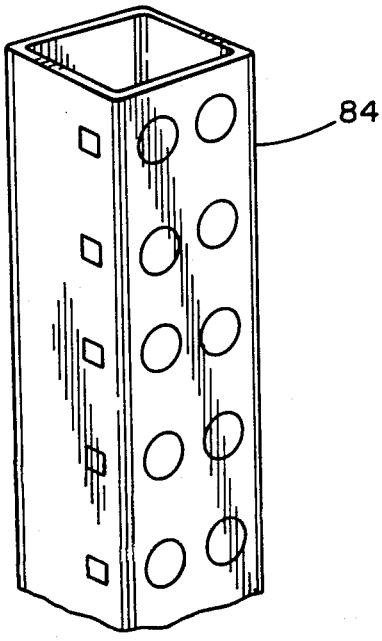
FIG. 9, similar to FIG. 8, shows a length of tubing of rectangular cross section formed in accordance with the present invention.

This process of forming knockout portions in a strip of metallic material is particularly conducive for use with a continuous rolling mill for forming the strip into a closed wall tube of either circular or rectangular cross section. A closed wall tube 82 of circular cross section is shown in FIG. 8 while a closed wall tube 84 of rectangular cross section is shown in FIG. 9, both tubes being formed in accordance with the present invention. A continuous rolling mill functions to transversely bend the strip until the lateral ends are brought into abutment and they are welded together to form a closed wall. Thereafter, dirt, grease, and other contaminants are removed from the formed tube by washing it, for example, by an alkali solution, and then subjecting the tube to a water rinse. Pickling fluid may then be sprayed on the tubing and a further rinse is used. Subsequent to the drying of the tube, corrosion protection is provided by passing the tube through a molten zinc bath for galvanizing the tube. Such a continuous rolling mill is described in commonly assigned U.S. Pat. Nos. 3,122,114 and 3,259,148, the teachings of which are hereby incorporated by reference. Additionally, the inside surface of the tubing can be coated shortly before or after the welding step as shown in commonly assigned U.S. Pat. No. 3,768,145, the teachings of which are also hereby incorporated by reference.

In the prior art, the flat strip was galvanized prior to punching the apertures. Thereafter, the strip could be formed into a tube in a manner similar to that described above except the galvanization step could not be employed. This step was precluded because, since the tube had apertures, the wash and rinse liquids would get inside the tube where they could not be effectively removed. If the galvanization step was included, the molten zinc bath would become contaminated quickly, and the pairing of water and molten zinc results in an explosive combination.

With the present invention, a strip having the coined knockout portions could be formed in a continuous rolling mill process including the steps of galvanization and coating the inside of the tubing. These steps are permitted because liquids, which are applied to the outside surface of the formed tube during the washing and rinsing, do not have access to the center of the tubing where they could contaminate the inside coating because the wall forming the tubing is impervious to the passage of fluid. Thus, the liquids could be removed by wiping and/or drying prior to the tubing reaching the molten zinc bath, just as in the formation of a solid wall tube without the provision of knockout portions.

The formation of the knockout portions in the strip could be completed off-line and the strip recoiled for use in the continuous roll forming mill process. On the other hand, the knockout portions could be provided on-line as a first step in the continuous roll forming process. In the latter case, an accumulator, such as shown in U.S. Pat. Nos. 3,122,114 and 3,259,148 would be required because the strip must be held stationary when the indentors enter and leave the plane of the strip. At other times, the progressive die drive means could advance the strip into the accumulator at sufficient speed that the accumulator could provide a constant output at the same feed rate as used by the continuous rolling mill.

The knockout formation method can be used with both strips of ferrous and non-ferrous metals. Furthermore, various other decorative or corrosion preventive coatings can be applied to the tubing during the roll forming process.

As a method of fabricating galvanized tubing from flat strip steel, the present invention includes several steps:

(a) The knockout portions 40 are formed in the flat strip, with each portion being defined by a first indentation 72 and a second indentation 74 with the indentations being in alignment and with a web 78 of material having substantially uniform thickness throughout its length spacing the indentations and with the web being disposed closer to the second than surface 70 of the flat strip to the first surface 68.

(b) The strip is transversely bent until the lateral ends thereof abut.

(c) The lateral ends are continuously welded together to form a tube.

(d) Liquids are applied to the outside surface of the tube to remove contaminants therefrom.

(e) The outside surface of the tube is rinsed with water.

(f) The outside surface of the tube is dried; and (g) The outside surface of the tube is galvanized by passing the tube through a molten zinc bath.

These steps of bending, welding, application of liquids, rinsing, drying and galvanizing are performed in a continuous rolling mill production mine. The step of forming the knockout portions includes the following substeps:

(a) The flat steel strip is impressed with an upstream indentor means at an upstream station of a progressive die arrangement to form an incipient knockout portion 40A with the impressing forming an incipient first indentation having a lesser extension from the first surface 68 of the flat strip than the first indentation 72 of the completed knockout portion 40 so that an incipient web is formed which has a greater thickness than the web of the completed portion; and (b) The flat steel strip is impressed with a downstream indentor means at a downstream station of the progressive die arrangement to form the final knockout portion 40.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An elongated wall formed of steel a first surface and a second surface spaced from said first surface;

a plurality of spaced knockout portions disposed in incipient apertures in said wall and disposed substantially between said surfaces, each knockout portion being defined by a first indentation encompassing the knockout portion and extending from said first surface, and by a second indentation encompassing the knockout portion and extending from said second surface, said first and second indentations being in alignment with a web of material of substantially uniform thickness throughout its length spacing said indentations, the outside surface defining said first indentation being inclined inwardly; and a coating applied to said second surface after formation of said indentations whereby application of a sharp blow to a knockout portion from said second surface causes fracture of the web to allow removal of said knockout portion without any material of said wall extending substantially beyond said first surface, said first indentation being substantially v-shaped so that the basal portion of said first indentation is pointer, said second indentation being substantially U-shaped partially defined by a generally flat basal surface aligned with the basal portion of said first indentation.

2. A wall as set forth in claim 1 wherein said basal portion of said first indentation is positioned closer to the outside surface defining said second indentation than to the inside surface defining the last-mentioned indentation.

3. A wall as set forth in claim 1 wherein said web is disposed closer to said second surface than to said first surface.

4. A wall as set forth in claim 1 which forms a tube, said first surface being the interior surface of said tube.

5. A wall as set forth in claim 1 which forms a channel, said first surface being the interior surface of said channel.

6. An elongated wall formed of metal comprising:

a first surface and a second surface spaced from said first surface;

a plurality of spaced knockout portions each defined by a first indentation encompassing the knockout portion and extending from said first surface, and further by a second indentation encompassing the knockout portion and extending from said second surface, said first indentations being substantially V-shaped, so that the basal portion of said first indention is pointed, said second indention being substantially U-shaped partially defined by a generally flat basal surface, and corresponding ones of said first and second indentations being in alignment with a web of material having substantially uniform thickness throughout its length spacing said indentations, said web being disposed closer to said second surface than to said first surface; and a coating applied to said second surface after formation of said indentations whereby application of a sharp blow to a knockout portion from said second surface causes fracture of the web to allow removal of said knockout portion without material of said wall extending substantially beyond said first surface.

7. A wall as set forth in claim 6 wherein each of said first and second surfaces is substantially flat.

* * * * *

UNITED STATES PATENT AND TRADEMARK OFFICE

CERTIFICATE OF CORRECTION

PATENT NO. : 4,869,969

DATED : September 26, 1989

INVENTOR(S) : Zorica Pavlov et al.

It is certified that error appears in the above-identified patent and that said Letters Patent is hereby corrected as shown below:

Face of Patent, Abstract, line 9, change "form" to --from--.

Column 7, line 24, after "steel" insert --comprising--.

Column 8, line 1, change "v" to --V--.

Column 8, line 2, change "pointer" to --pointed--.

Signed and Sealed this

Second Day of October, 1990

*Attest:*

HARRY F. MANBECK, JR.

*Attesting Officer*

*Commissioner of Patents and Trademarks*